US006591991B2

(12) United States Patent
Belle

(10) Patent No.: US 6,591,991 B2
(45) Date of Patent: Jul. 15, 2003

(54) COLLAPSIBLE TIRE STAND

(76) Inventor: Luce Belle, 235. Fort-Rémy, Lasalle, Québec (CA), H8R 4C5

( * ) Notice: Subject to any disclaimer, the term of this patent is extended or adjusted under 35 U.S.C. 154(b) by 0 days.

(21) Appl. No.: 09/922,553

(22) Filed: Aug. 6, 2001

(65) Prior Publication Data

US 2003/0024886 A1 Feb. 6, 2003

(51) Int. Cl.[7] ..... A47F 7/04
(52) U.S. Cl. ..... 211/24
(58) Field of Search ..... 211/24, 23, 195, 211/200

(56) References Cited

U.S. PATENT DOCUMENTS 1,685,925 A * 10/1928 Linck et al. ..... 211/135
2,746,703 A * 5/1956 Emery ..... 211/195
2,815,128 A 12/1957 Kauffman
2,931,511 A 4/1960 Crum
3,510,007 A 5/1970 Walklet
3,881,677 A 5/1975 Ulenfeld
3,935,948 A 2/1976 Podojil
4,046,260 A * 9/1977 Tallon ..... 211/195
4,245,850 A * 1/1981 Boudreau ..... 280/644
4,763,865 A * 8/1988 Danner ..... 108/118
4,789,070 A * 12/1988 Bennett ..... 211/200
4,823,965 A * 4/1989 Hughes ..... 211/200
4,917,341 A * 4/1990 Pirchio ..... 108/118
5,621,850 A 4/1997 Kane et al.
5,816,545 A * 10/1998 Malizia ..... 108/118
6,257,419 B1 * 7/2001 Kamysiak ..... 211/22
6,328,168 B1 * 12/2001 Mani ..... 211/23

* cited by examiner

*Primary Examiner*—Alvin Chin-Shue
*Assistant Examiner*—Sarah Purol

(57) ABSTRACT

A collapsible tire stand is comprised of a frame and said frame preferably made up of a pair of U-shaped members each comprised of a base segment and toward each ends of the base segment extends a supporting member extending perpendicularity therefrom and between each pairs of supporting members are nesting strips into which tires are meant to nest and each of the nesting strips are positioned in pair, one pair being located adjacent the distal tip of the supporting members and a second pair positioned in a spaced relationship proximal to the base segment to allow the tire mounted thereon to remain in a spaced relationship relative to the ground surface.

1 Claim, 2 Drawing Sheets

COLLAPSIBLE TIRE STAND

FIELD OF THE INVENTION

The present invention relates to the general field of storage accessories and is particularly concerned with a tire stand.

BACKGROUND OF THE INVENTION

There are many situations where it may be desirable to store tires in a generally upright configuration. One of such situations relates to the displaying of tires for retail sales or the like. Another situation is commonly seen during the changing of tires of trucks and cars where it is sometimes desirable to secure the tire in a proximate and upright relationship with the car so as to facilitate and expedite the tire changing operation.

Still another common situation where it may be desirable to secure the tire in a generally upright configuration, relates to the general storage of tires between seasons. Indeed, in most areas where seasons bring about different driving conditions, such as in North America, where so-called winter tires are used during the winter to provide a better grip on snow and ice and so-called summer tires are used the remainder of the year.

It is often desirable to store the off-seasons tires in such a manner that they occupy minimal storage space. Regardless of the reason why the tire must be supported in a generally upright condition away from the vehicle, it is also desirable that the tire be adequately supported so as to reduce the risk of deforming or otherwise damaging the tire.

The prior art offers some examples of structures adapted to secure a tire in a generally upright position. In general, prior art developments with respect to such structures have taken two somewhat different approaches. One approach is represented by stands which generally grasp a tire or other such article proximate a lower portion thereof such as to provide a support proximate a seating surface for the article to be supported.

Stands of this type however suffer from numerous drawbacks including the fact that they are generally not amenable to the display of articles of different sizes. Furthermore, the gripping of a tire or other toroidal objects solely about a lower portion when in a generally upright position, tends to provide a decided lack of stability. The other approach to the supporting of generally toroidal articles has been to suspend them in some manner about a hook or other retaining device which is in some manner positioned a distance above a floor or other seating surface. Stand of this type have generally exhibited a number of problems in commercial applications.

In order to withstand the weight of certain types of toroidal articles, these stands have often employed relatively massive structures which prove to be structurally cumbersome. In addition, many of these devices are not capable of being collapsed or at least collapsing to an essentially planar form such that temporary storage or transposition become significant problems.

In other instances, this type of device has proven to be somewhat unstable due to the characteristics of the materials employed in the construction or because of the inherent structure of the device.

Accordingly, the various prior approaches to stands for the suspension of generally toroidal article has not produced a device which has achieved broad commercial acceptance. Hence, there exists a need for an improved toroidal article stand.

Advantages of the present invention include the fact that the proposed stand is specifically adapted to support a tire or other toroidal articles in a generally upright position away from a ground surface. The proposed stand is specifically designed so as to support the tire in such a manner as to reduce the risk of altering or damaging the said tire.

Furthermore, the proposed stand is designed so as to be relatively stable even when the tire is mounted thereon. The proposed stand is further designed so as to be collapsible when not in use, thus reducing the need for storage space.

Still further, the proposed stand is particularly well suited to store a pair of tires in an overlying relationship relative to each other thus making better use of storage space.

The proposed stand is designed to allow for ergonomic installation and retrieval of the tires into and out of the stand. Furthermore, the proposed stand is specifically designed to be manufacturable using conventional components and conventional forms of manufacturing in order to provide a toroidal object stand which will be economical feasible, long lasting and relatively trouble free in operation.

BRIEF DESCRIPTION OF THE DRAWINGS

An embodiment of the present invention will now be disclosed, by way of example, in reference to the following drawings, in which.

DETAILED DESCRIPTION

Figure 2:
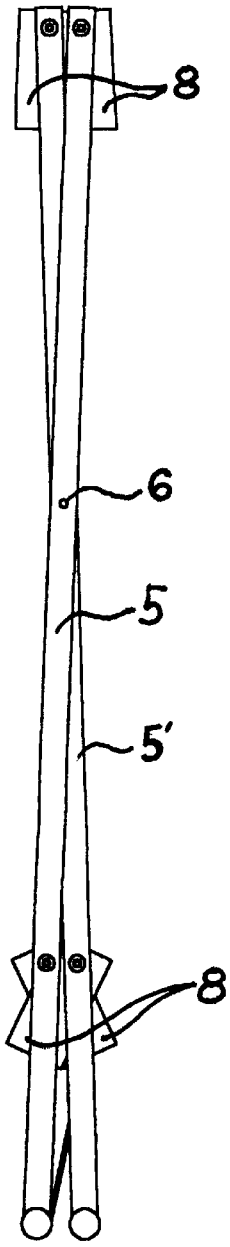
FIG. 2: in an elevational view, illustrates a tire stand in accordance with an embodiment of the present invention, the tire stand being shown in a collapsed configuration.
Figure 1:
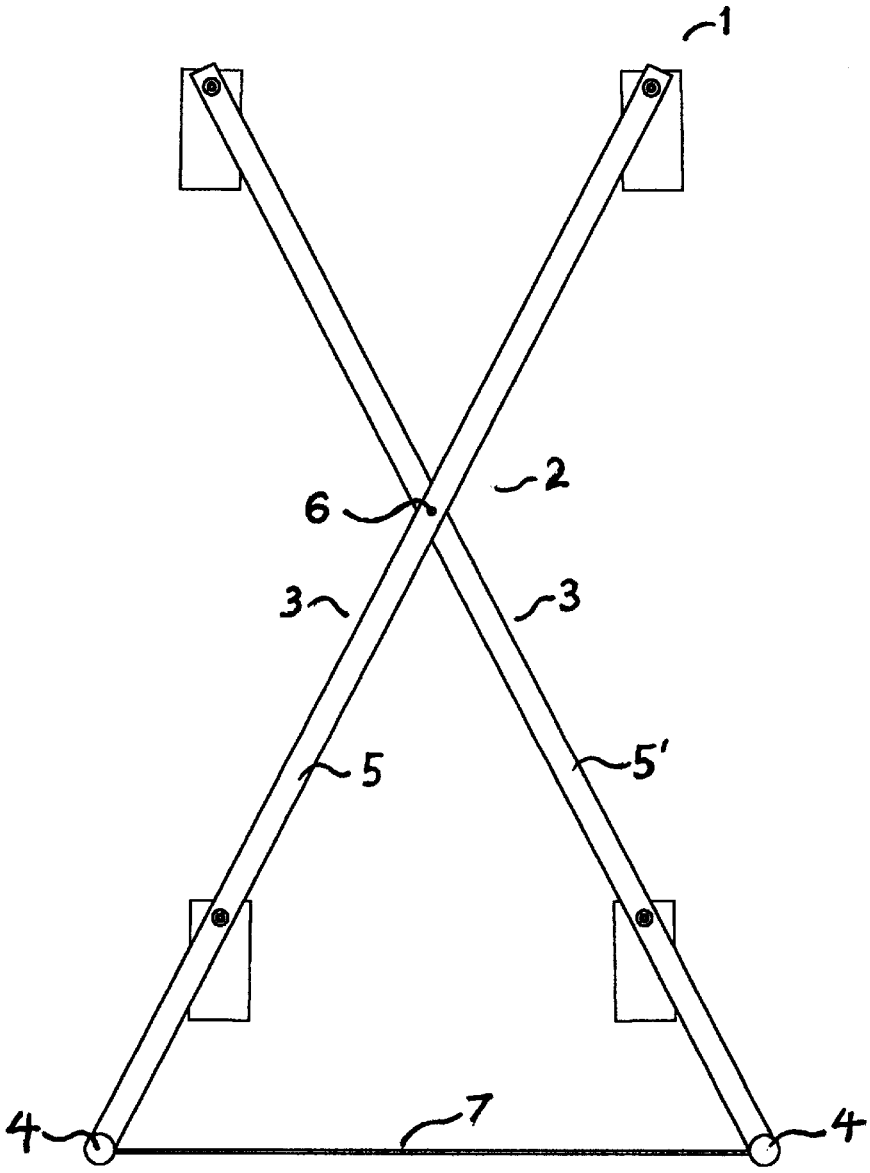
FIG. 1: in an elevational view, illustrates a tire stand in accordance with an embodiment of the present invention, the tire stand being shown in an operational configuration.

FIG. 1: A tire stand 1 has a collapsible frame 2 and said frame 2 is preferably made up of a pair of U-shaped members 3 each comprised of a base segment 4 and toward each ends of the said base segment 4 extends supporting members 5, 5' extending perpendicularity therefrom. The U-shaped members 3 are mounted so as to be laterally offset relative to each other and, thus, one of the supporting members 5' is inwardly laterally offset relative to the longitudinal end of the base segment 4 so as to accommodate the adjacent supporting segment 5 of the U-shaped member 3. Moreover, the U-shaped members 3 are pivotally attached together by a pair of hinge means 6 taken from the group comprised of but not limited to rivets, screws, bolts or any other suitable means extending transversally though adjacent supporting segments 5, 5'. The hinge means 6 allows the U-shaped members 3 to pivot between their operational extended configuration as shown here and the collapsed configuration shown in FIG. 2. To limit the movement of the U-shaped members 3 to a predetermined extended configuration, a limiting means 7 is taken from the group comprising but not limited to flexible strip, band or wire extending between opposed base segments 4.

Figure 3:
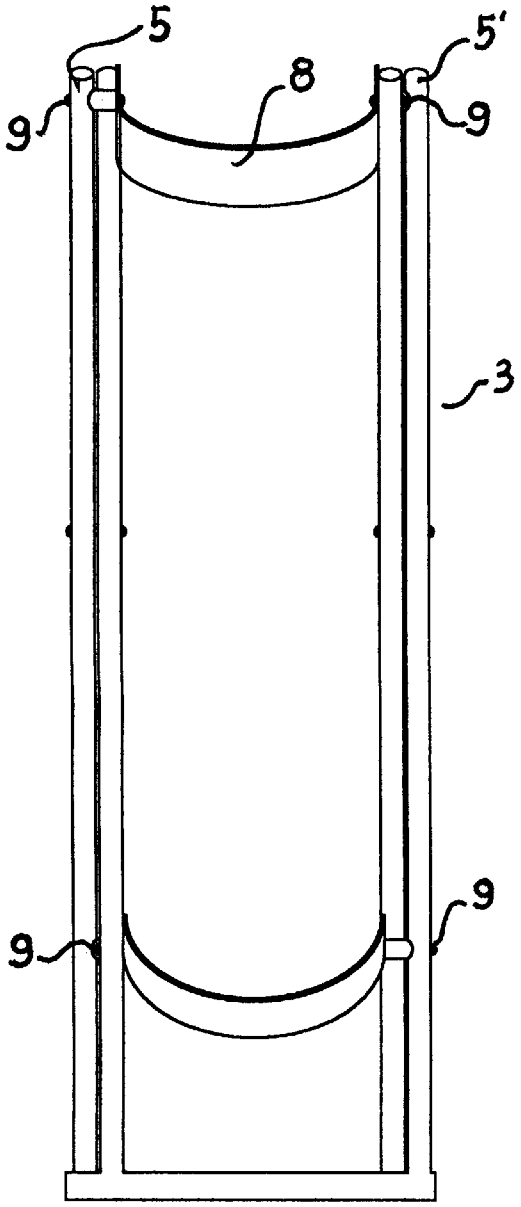
FIG. 3: in a side view, illustrates a tire stand in accordance with an embodiment of the present invention.

FIG. 3: Nesting strips 8 are pivotally mounted between the supporting segments 5, 5' of the U-shaped members 3 at predetermined locations. The nesting strips 8 are typically configured, sized and positioned so as to be able to receive and support a conventional pneumatic tire. Typically, although by no means exclusively, the nesting strips 8 are made out of a suitable polymeric resin such as nylon. The nesting strips 8 are pivotally attached to the supporting segments 5, 5' by a suitable pivotable attachment means 9 taken from the group comprised of but not limited to pins, rivets, nuts or screws.

Figure 4:
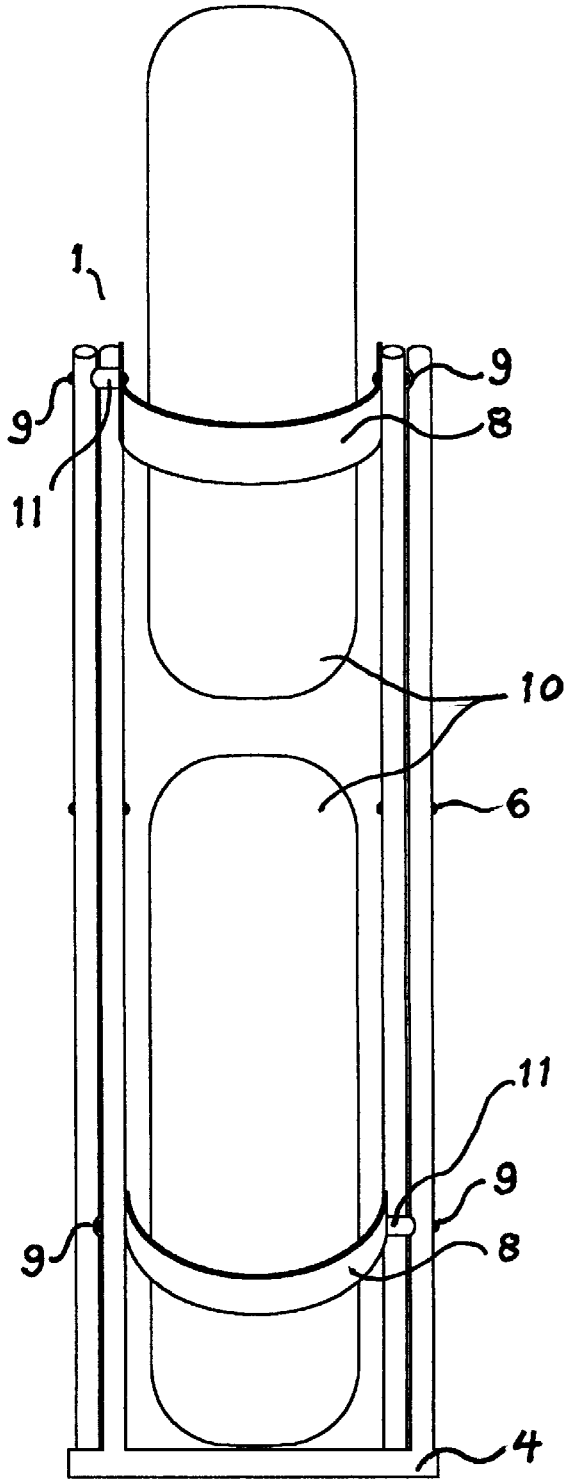
FIG. 4: in a side view, illustrates a tire stand as shown in FIG. 3 with a pair of conventional tires mounted thereon.

FIG. 4: The pivotal mounting of the nesting strips 9 allow the stand 1 to accommodate tires 10 of various diameters while the flexible nature of the nesting strips 9 allows the said stand 1 to accommodate tires 10 of various widths. Preferably, the nesting strips 9 are positioned in pair, one pair being located adjacent the distal tip of the supporting members 5, 5' while a second pair is positioned in a spaced relationship proximal to the base segment 4 to allow the tire 10 mounted thereon to remain in a spaced relationship relative to the ground surface. Preferably, the hinge means 6 is located substantially intermediate the first and second nesting strips 8. In order to provide for a symmetrical support of the tires 10, in view of the lateral offsetting between the U-shaped members 3, spacing segments 11 are preferably mounted in a generally perpendicular relationship relative to the supporting members 5, 5' in order to compenate for the lateral offsetting.

What is claimed is:

1. A tire stand for vertically storing a pair of tires comprising:

a pair of generally U-shaped members pivotally mounted relative to one another so as to be able to pivot between parallel relationship to each other and a generally X-shaped relationship relative to one another;

a limiting means for limiting the angular displacement of the U-shaped members relative to one another when the latter reach their generally X-shaped configuration;

each U-shaped member including a base segment and a pair of generally perpendicularly extending supporting members;

a nesting strip extending between the supporting members;

whereby adjacent nesting strips of opposed U-shaped members are adapted to be used for nestingly receiving a tire.

* * * * *